United States Patent [19]

Kobelt

[11] 4,326,612

[45] Apr. 27, 1982

[54] CONTROL DEVICE FOR MARINE GEARBOX AND ENGINE

[76] Inventor: Jacob Kobelt, 6110 Oak St., Vancouver, British Columbia, Canada, V6M 2W2

[21] Appl. No.: 114,606

[22] Filed: Jan. 23, 1980

[51] Int. Cl.[3] ..... B60K 41/02; G05G 9/14

[52] U.S. Cl. ..... 192/0.096; 74/473 R; 74/477

[58] Field of Search ..... 192/0.084, 0.092, 0.096; 74/473 R, 473 P, 475, 477, 497, 502, 503, 874, 875, 876, 879

[56] References Cited

U.S. PATENT DOCUMENTS

| | | | |
|---|---|---|---|
| 2,971,618 | 2/1961 | Morse | 192/0.096 |
| 3,134,269 | 5/1964 | Shimanckas | 192/0.096 X |
| 3,202,011 | 8/1965 | Kobelt . | |
| 3,204,733 | 9/1965 | Morse | 192/0.096 |
| 3,330,390 | 7/1967 | Kobelt . | |
| 4,013,155 | 3/1977 | Olsen | 74/879 X |
| 4,232,771 | 11/1980 | Prince | 192/0.096 |

*Primary Examiner*—George H. Krizmanich

*Attorney, Agent, or Firm*—Carver & Co.

[57] ABSTRACT

A control function splitter for controlling a clutch and gearbox assembly and a throttle, particularly in marine applications. The splitter has main and override throttle shafts, and a clutch operating shaft connected to engine and assembly inputs. The splitter has a cam which moves axially to reflect control head signals. The cam has portions representing travel for gear engagement only with no throttle change, and travel between idle and full throttle with no gear change. A motion converting structure converts axial cam movement to limited clutch shaft rotation. An interlock between the clutch shaft and override throttle shaft prevents rotation of the clutch operating shaft unless both throttle shafts are at idle, and also prevents rotation of the override throttle shaft unless the clutch shaft is in neutral. The splitter reduces previous problems associated with non-lineality between a control head signal and the corresponding throttle output signal, and also improves positive "feel" of gear selection. Also, tendency of engine speed governor to cause speed setting to creep is markedly reduced.

12 Claims, 7 Drawing Figures

CONTROL DEVICE FOR MARINE GEARBOX AND ENGINE

BACKGROUND OF THE INVENTION

1. Field of the Invention

The invention relates to a control device for a marine gearbox and engine, and in particular to a device for use with a single lever control adapted to control concurrently an engine and reversible marine gearbox, and an override throttle control for use with the gearbox in neutral.

2. Prior Art

Single lever controls are widely used in marine applications, particularly in multi-station arrangements where the main propulsion engine and clutch and gearbox assembly can be controlled from several different locations or stations in the vessel through single lever control heads provided at the stations. The gearbox usually incorporates two clutches associated with forward and reverse gears and can be referred to as a clutch and gearbox assembly, or more simply as a gearbox. The lever has an intermediate neutral position straddled by forward and reverse positions in which the lever can move between idle and full speed in either forward or reverse. In many applications where auxiliary equipment, such as a pump or winch, is to be operated by the main propulsion engine, a separate independent throttle control is also provided to control the engine when powering the auxiliary apparatus alone and the main gearbox is in neutral. This separate control is referred to as an override throttle control and preferably an interlock is provided to prevent operation of the override throttle control except when the gearbox is in neutral.

it can be appreciated that these various control functions have to be integrated into a common input apparatus, and then split as two separate control functions which are coupled separately to the engine and gearbox. This apparatus can be referred to as a control function splitter apparatus which receives an input signal from one of the single lever control heads. This signal results initially in selecting either forward or reverse from the neutral position in the gearbox, after which the throttle can be shifted from idle to any position up to full throttle. It is important that the engine is not accelerated until the forward or reverse gear is fully engaged, and correspondingly it is important that the gear is not shifted until the engine has been returned to idle. Such splitter apparatus is usually positioned remotely from the various control heads and is connected to the controls through push-pull cables, pressurized fluid lines, tensioned cables and sheaves, etc. In larger vessels, where lengths of lines or cables and the number of stations can become excessive, pneumatic controls are preferable to push-pull cables or cable and sheave systems.

Commonly, prior art splitter apparatus coupling the various control heads to the engine and gearbox have been complex and have commonly resulted in a non-linear relationship between control lever setting and throttle position. This often resulted in a non-characteristic "feel" at the control lever in which an operator may experience difficulty in "feeling" selection of the particular mode of gearbox operation. Also, the non-lineality of the splitter apparatus sometimes introduced difficulties where the engine speed governor had sufficient force to cause "creep" in the controls, such that a desired engine setting is not maintained unless continually monitored and manually corrected as required.

SUMMARY OF THE INVENTION

The invention reduces difficulties and disadvantages of the prior art by providing a control function splitter unit in which difficulties associated with non-lineality between the throttle control setting and the splitter unit are reduced. Furthermore, the complexity of prior art devices is also reduced, thus simplifying manufacturing and servicing of the unit. The apparatus is adaptable to a multi-station arrangement and can be used with push-pull cables, pneumatic or hydraulic lines, tensioned cable and sheave systems, and equivalents.

A control function splitter apparatus according to the invention controls through at least one single lever control unit, a clutch and gearbox assembly and a throttle associated with an engine. The control unit has a casing, a main throttle shaft adapted to cooperate with the speed control of the engine, an override throttle shaft, and a clutch operating shaft adapted to cooperate with a clutch of a reversible gearbox having an intermediate neutral position. The three shafts are journalled for rotation in the casing, the main throttle shaft and override throttle shaft being rotatable between idle and full speed positions, and the clutch operating shaft being rotatable between engaged forward and reverse positions with an intermediate position being neutral.

The control function splitter apparatus is further characterized by a cam, a cam follower, a motion converting means and interlock means. The cam is mounted for rectilinear axial movement relative to the casing and is adapted to cooperate with the single lever control unit to reflect actuation thereof. The cam has an inner portion corresponding to intermediate cam travel and two outer portions corresponding to outer cam travel, the outer portions being positioned on each side of the inner portion. The cam follower cooperates with the cam and the main throttle shaft so that axial movement of the cam during intermediate cam travel produces no throttle shaft movement, and axial movement of the cam during subsequent outer cam travel produces corresponding rotation of the main throttle shaft. The motion converting means cooperates with the cam and the clutch operating shaft to convert axial movement of the cam during intermediate cam travel to rotation of the clutch operating shaft and to prevent further rotation of the clutch operating shaft during subsequent outer cam travel. The interlock means cooperates with the clutch operating shaft and the override throttle shaft so that rotation of the clutch operating shaft is prevented unless both throttle shafts are in their respective idle positions, and rotation of the override throttle shaft is prevented unless the clutch shaft is in neutral.

A detailed disclosure following, related to drawings, describes a preferred embodiment of the invention which is capable of expression in structure other than that particularly described and illustrated.

DETAILED DISCLOSURE

FIG. 1

Figure 1:
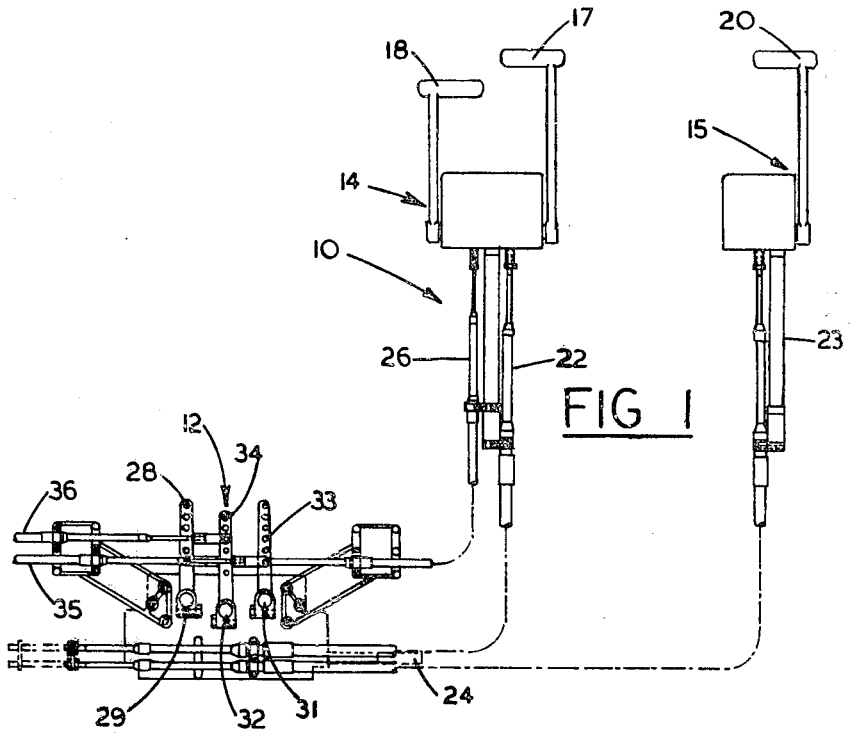
FIG. 1 is a layout schematic showing a control function splitter apparatus cooperating with control levers at control heads of two separate stations controlling a marine engine and clutch and gearbox unit.

A control set-up 10 utilizes a control function splitter apparatus 12 according to the invention and is shown coupled to a twin lever control head 14 and a single lever control head 15. The control head 14 has a conventional single lever control handle 17 controlling a clutch and a throttle of a reversible gearbox assembly and a marine engine, not shown. The control head 14 also has an override throttle control handle 18 for controlling the throttle only when the clutch is in neutral, and is used when powering auxiliary equipment such as pumps, winches, etc. The single lever control head 15 includes a single lever control handle 20 which is equivalent to the handle 17 but is located at a separate station and requires no further discussion but is included merely to show a two station set-up.

Push-pull cables 22 and 23 extend from the single lever control handles 17 and 20 to connect to an input bar 24 of the apparatus 12, and a push-pull cable 26 extends from the override throttle handle 18 to an override throttle input lever 28 of the apparatus 12. The apparatus 12 has an override throttle shaft 29 carrying the override throttle input lever 28, a main throttle shaft 31 carrying a main throttle output lever 33, and a clutch operating shaft 32 carrying a clutch output lever 34. Connecting means 35 and 36 are connected to the throttle output lever 33 and the clutch output lever 34 respectively and extend to appropriate portions of the engine and clutch and gearbox assembly respectively.

Figure 4:
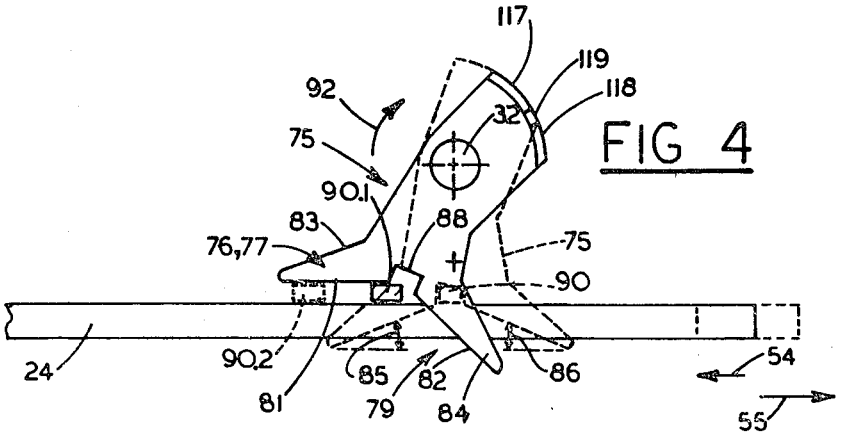
FIG. 4 is a simplified fragmented side elevation similar to FIG. 2, showing a portion of motion converting means according to the invention.
Figure 2:
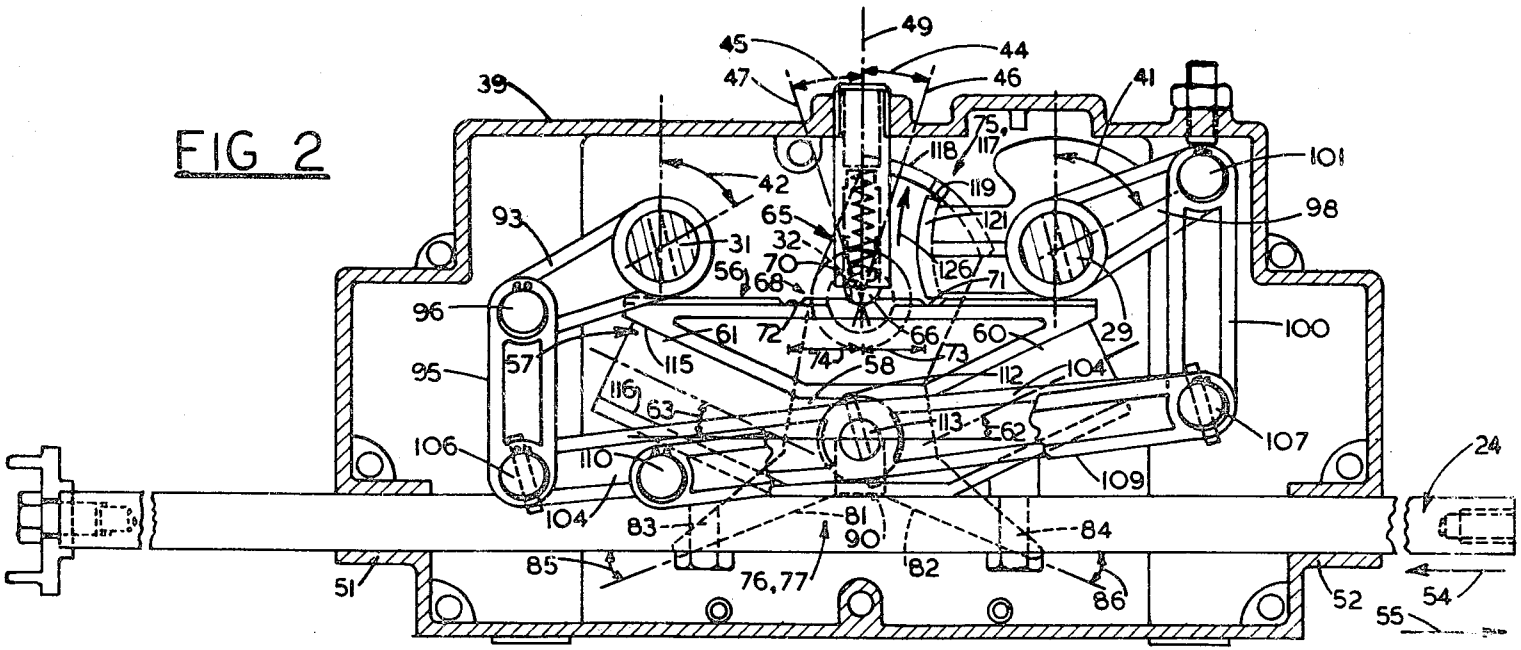
FIG. 2 is a simplified fragmented sectional side elevation through a portion of the control function splitter apparatus according to the invention, some portions being removed for clarity, the apparatus being shown with the throttle at idle and the gear control in neutral.
Figure 3:
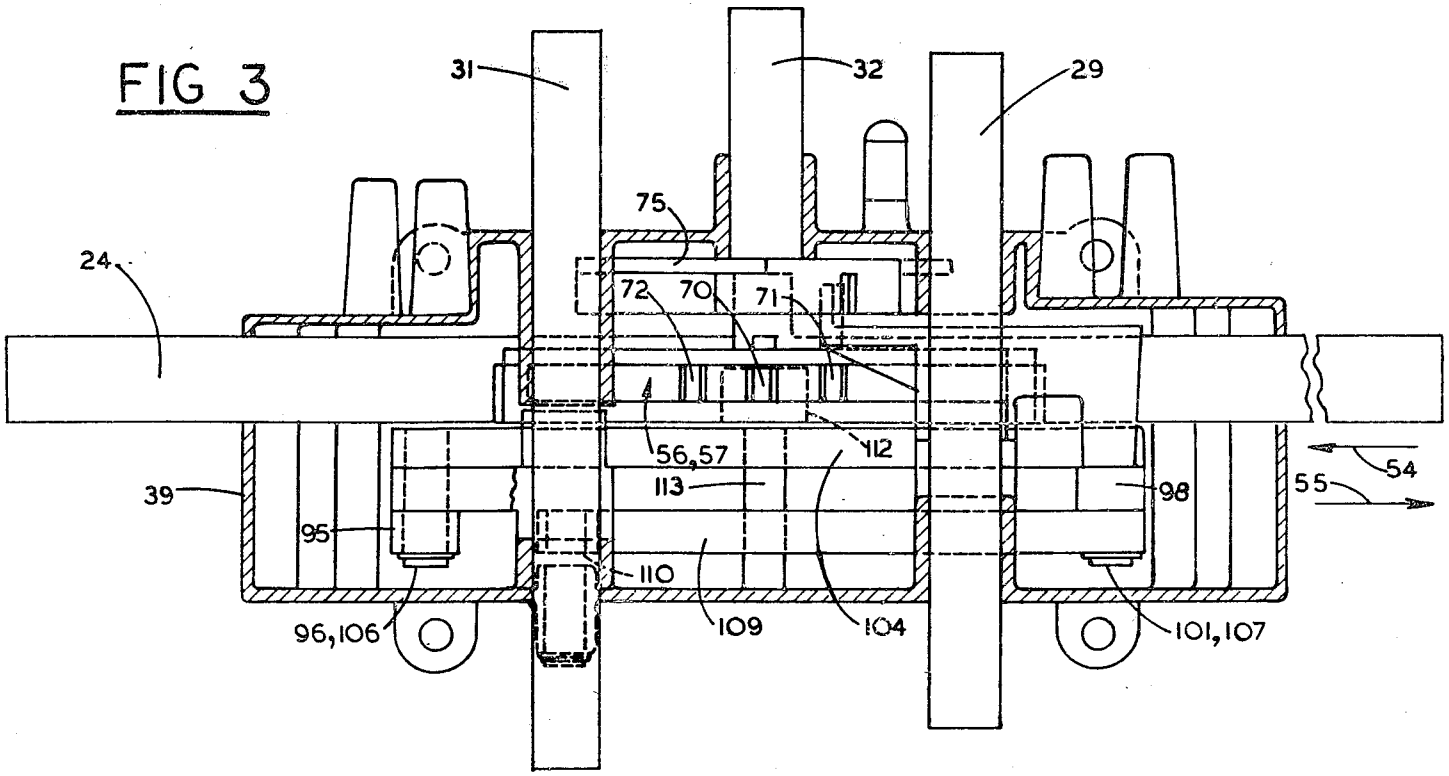
FIG. 3 is a simplified fragmented sectional top plan of the apparatus as seen in FIG. 2, some portions being removed.

FIGS. 2 through 4

Referring mainly to FIG. 2, the control function splitter unit 12 has a casing 39, and the three shafts 29, 31 and 32 are parallel to each other and journalled for rotation in the casing in undesignated bearings. The main throttle shaft 31 and the override throttle shaft 29 are rotatable through about 60 degrees between idle and full speed positions, as will be described, limits of rotation being designated by an angle of swing 41 for the shaft 29, and an angle of swing 42 for the shaft 31, as shown only in FIG. 2. The clutch operating shaft 32 is rotatable between engaged forward and reverse positions 46 and 47 within an intermediate position 29 being neutral. The shaft 32 is shown in the neutral position, and angles of swing 44 and 45 of about 17 degrees each represent shaft rotation required to engage fully forward and reverse gears respectively in the gearbox assembly.

The input bar 24 is carried in sliding journals 51 and 52 provided at opposite ends of the casing 39 to mount the bar for longitudinal sliding in directions of arrows 54 and 55 reflecting forward and reverse commands from the control heads. The input bar carries a cam 56 having a generally flat bottomed V-shaped guide means 57 having a groove with an inner portion 58 aligned with rectilinear axial movement of the cam, that is aligned with the arrows 54 and 55, and outer portions 60 and 61 inclined to axial movement of the cam at angles 62 and 63 respectively. Thus, the cam 56 is mounted for rectilinear axial movement relative to the casing and is adapted to cooperate with the single lever control unit to reflect actuation thereof. The outer portions 60 and 61 represent forward and reverse throttle actuating portions respectively and extend on opposite sides of the inner portion. The cam thus has the inner portion 58 corresponding to intermediate cam travel, and the two outer portions 60 and 61 corresponding to outer cam travel, the outer portions being positioned on each side of the inner portion. The angles 62 and 63 are shown to be equal for simplicity and for duplication of handle shift and corresponding throttle increments, but alternate assymmetrical angles can be selected if desired. The angles 62 and 63 represent ratio between incremental movements of the control handle 17 (FIG. 1 only) and corresponding changes in engine speed setting as will be described.

The casing 39 has a casing indexing means 65, namely a spring-loaded detent 66, which is adapted to engage cam indexing means 68 associated with the cam and complementary to the casing indexing means. The cam indexing means 68 includes recesses 70, 71 and 72 to receive the detent 66 in the neutral, forward and reverse positions respectively. The recesses 71 and 72 are positioned at equal spacings 73 and 74 respectively from the recess 70 and on opposite sides of the recess 70.

The clutch operating shaft 32 carries a rotary cam 75 which is shown mostly in broken outline in FIG. 2 and more clearly in FIG. 4, and is adapted to serve two functions as will be described. The first function is as a motion converting means 76, in which function the cam has a recess portion or fork 77 having a pair of fork arms 83 and 84 having swept faces 81 and 82 respectively which define in part a V-shaped recess 79. The faces 81 and 82 are inclined at angles 85 and 86 respectively to the axial direction, which angles are proportional to rotation of the clutch operating shaft between the engaged positions, as will be described. A generally rectangular shaped indentation 88 is provided between the two swept faces 81 and 82, so as to form a continuous surface extending between the swept faces.

In FIG. 4, the V-shaped guide means 57 of the cam 56 is omitted for clarity, but the cam 56 can be seen to include a driver member 90 which is of a size to be received in the rectangular indentation 88 when the clutch shaft 32 is in neutral. The relative positions of the fork 77 and member 90 are shown in full outline in FIG. 2, and in broken outline in FIG. 4. As best seen in FIG. 4 the driver member is positioned relative to the bar 24 and the recess portion 77 such that initial movement of the bar in direction of the arrow 54 from mid stroke or the neutral position, broken outline, moves the driver member 90 in the same direction, thus causing rotation of the portion 77 and with it the shaft 32 in direction of an arrow 92. When the driver member 90 completely leaves the rectangular indentation 88 and attains a position 90.1, shown in full outline in FIG. 4, the swept face 81 is now disposed generally parallel to the direction of arrow 54. There is thus clearance for additional axial movement in the same direction of the member 90 to attain a position 90.2, broken outline in FIG. 4, at the outer limits of stroke of the bar 24, which additional movement results in no further rotation of the shaft 32. The recesses 71 and 72, which correspond to forward and reverse, are at the spacings 73 and 74 respectively from the recess 70, which corresponds to neutral, such that the springloaded detent 66 engages the particular recess at a position coinciding with the termination of the rotation of the shaft, that is when the swept faces become parallel to the direction 54.

Thus, the indexing means 65 and 68 are engaged in the cam neutral position, and also in the positions of the cam indicating complete engagement of the gear in either the forward or reverse positions. Intermediate cam motion between the recesses represents at least minimum movement required to fully engage the particular gear. Motion of the driver in the opposite direction produces initial rotation of the clutch operating shaft in the opposite direction followed by zero rotation of the shaft during subsequent axial movement of the driver.

Thus, it can be seen that the driver member 90 cooperates with the cam 56 and is interposed between the two inclined swept faces 81 and 82 to be accepted within the rectangular indentation 88 in the neutral position so that axial movement of the driver in a particular direction from the neutral position and through the intermediate position causes the driver member to engage a side of the indentation and one of the swept faces to initially rotate the clutch operating shaft to one of the engaged positions. Subsequent axial movement of the cam, and with it the driver member, in the same direction through outer cam travel causes the driver member to move along the swept face without further movement of the clutch operating shaft.

It can be seen that the driver 90, the complementary rectangular indentation 8 and the swept faces 81 and 82 of the rotary cam are in fact motion converting means cooperating with the cam and the clutch operating shaft to convert axial movement of the cam during intermediate cam travel to rotation of the clutch operating shaft, and to prevent further rotation of the clutch operating shaft during subsequent outer cam travel.

Referring mainly to FIG. 2, the main throttle shaft 31 has a main throttle arm 93 extending rigidly therefrom, and a main throttle arm connecting link 95 has a first end hinged to the main throttle arm on a hinge pin 96. The override throttle shaft 29 has an override throttle arm 98 extending rigidly therefrom and is disposed so as to be generally parallel to the main throttle arm when both the throttle shafts are in idle. The arms 93 and 98 extend in opposite but parallel directions from their respective shafts to form a portion of what is effectively a parallelogram mechanism, as follows. An override throttle arm connecting link 100 has a first end hinged to the override throttle arm with a hinge pin 101. A throttle follower link 104, serving as a throttle follower means, has opposite ends connected to the main throttle arm connecting link 95 and override throttle arm connecting link 100 with hinge pins 106 and 107 respectively, thus forming a mechanism of three links pinned to two rotary arms. It can be seen that each connecting link 95 and 100 has one end hinged to a respective arm 93 and 98, and an opposite end hinged to first and second portions respectively of the throttle follower means. The arms 93 and 98 and the link 104 have particular lengths and are disposed at their particular inclination such that the main throttle arm connecting link 95 and override throttle arm connecting link 100 are disposed so as to be generally parallel to each other.

As seen also in FIGS. 2 and 3, a control arm 109 has an inner end hinged on a hinge pin 110 mounted in the casing 39, and an outer end hinged on the pin 107 adjacent the throttle follower means 104 and the connecting link 100. Thus, the links 100 and 104 and the arm 109 have ends hinged on the pin 107. The control arm 109 is provided to control motion of the pin 107 and thus limit movement to some extent of the mechanism of links, as will be described.

A roller 112 is journalled on a pin 113 carried at an approximate mid position of the throttle follower link 104 and is received within the V-shaped guide means 57 of the cam 56. The groove of the means 57 is defined by spaced side walls 115 and 116 and the roller has a cylindrical periphery which engages the side walls of the groove for relative mevement therebetween and for rotation relative to the throttle follower link. As will be described with reference to FIGS. 5 through 7, when the roller 112 is in either of the outer portions of the cam, axial movement of the cam 56 produces corresponding swinging movement of the throttle follower means 104 via the roller 112, which movement is transmitted to the throttle shafts, as appropriate.

Referring again to FIGS. 2 and 4, the second function of the rotary cam 75 of the clutch operating shaft 32 is to serve as an interlock means 117 to prevent undesirable concurrent operation of the clutch and throttle. A portion of the means 117 which is associated with the clutch operating shaft has a stop portion 118 which is a curved projecting wall extending from the cam 75 and having two opposite surfaces of revolution centered on the clutch operating shaft. The stop portion has a clearance opening 119 in an approximate mid position thereof. The override throttle shaft 29 has a locator 121 extending therefrom, the locator being a curved projecting wall having opposite surfaces of revolution centered on the override throttle shaft. The wall of the locator 121 extends towards the wall of the stop portion 118 and has a width sufficient to pass through the clearance opening 119 of the stop means 118 upon rotation of the override throttle shaft when the clutch operating shaft is in the neutral position. It can be seen that when the clutch operating shaft is out of the neutral position, initial rotation of the override throttle shaft causes interference between the locator 121 and the stop means 118 which effectively prevents rotation of the override throttle shaft. In FIG. 2, the override throttle shaft 29 is shown at idle, which condition is identical with the main throttle shaft 31 condition due to the coupling of the links 95, 100 and 104. At idle, the locator 121 is disposed inwardly of and clear of the stop portion 118 so as not to interfere therewith, thus permitting rotation of the clutch operating shaft 32. Thus rotation of the clutch shaft 32 can occur only when the throttle shafts are at idle.

Thus, it can be seen that the stop portion 118, the clearance opening 119 and the locator 121 serve as interlock means cooperating with the clutch operating shaft and the override throttle shaft so that rotation of the clutch operating shaft is prevented unless both throttle shafts are in their respective idle positions, and that rotation of the override throttle shaft is prevented unless the clutch shaft is in neutral. Also, when the clutch operating shaft is in neutral, rotation of the override throttle shaft is transmitted through the respective arms and links to the main throttle shaft. Thus the throttle follower means cooperates with the main throttle shaft and with the override throttle shaft so that when the clutch is in the neutral position, rotation of the override throttle shaft is transmitted to the main throttle shaft, and vice versa.

OPERATION

FIGS. 2 and 5 through 7

Referring to FIG. 2, it can be seen that the roller 112 is at a mid position of the inner portion 58 of the V-shaped guide means 57 with the detent 66 engaging the recess 70 reflecting that the clutch shaft is in neutral position. Both throttle shafts are shown at idle, and the locator 121 is aligned with, but clear of, the opening 119, thus permitting rotation of the override throttle shaft 29 in direction of the arrow 92 to assume a position shown in FIG. 5.

Figure 5:
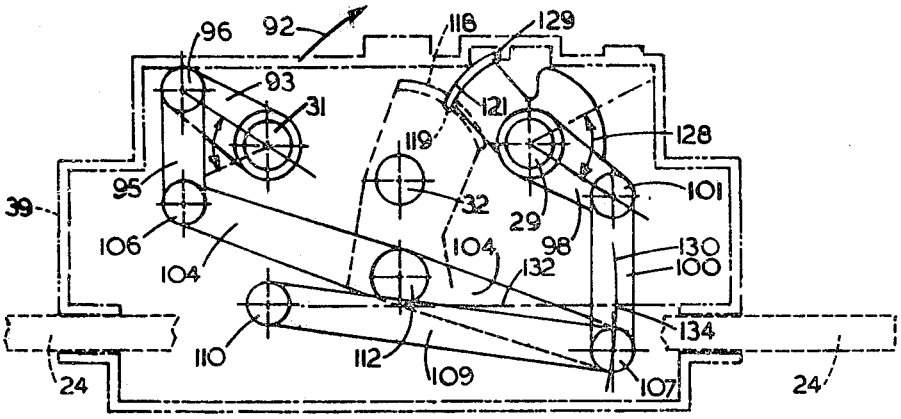
FIG. 5 is a further simplified diagram similar to FIG. 2 with the gear in neutral and the override throttle set at full throttle.

In FIG. 5, it is seen that the locator 121 on the shaft 29 has rotated from the position shown in FIG. 2 in the direction of the arrow 92 through an angle 128 until the locator 121 interferes with the casing at 129, thus limiting further movement of the override throttle shaft 29. The arm 98 has thus swung downwards and the link 100 transmits this motion through the pin 107 to the throttle follower 104, which rocks about the roller 112 causing the opposite end of the follower 104 carrying the pin 106 to move upwards a corresponding amount. The pin 106 transfers the upwards motion to the link 95, thence to the arm 93, which similarly rotates the main throttle shaft 31 in the same direction as the throttle override shaft 29 until there is interference between the arm 93 and the casing 39. In all likelihood, either the arm 93 or the locator 121 would first interfere with the casing, so that interference with the casing would occur at one point only.

The downwards motion of the pin 107 is constrained by the control arm 109 which carries the pin 107 at its outer end and constrains it to follow an arc 130 centered on the pin 110 at the opposite end of the arm 109. Thus the arm 109 defines path or locus of the pin 107 between upper and lower limits shown in FIGS. 2 and 5 respectively. The pin 110 is located on an axis 132 which passes through an approximate mid point 134 of the arc 130. Thus, the inner end of the control arm 109 is hinged on the pin 110 carried in the casing at a position aligned with an approximate mid position of the arc 130, which arc represents total stroke of the adjacent hinged ends of the override throttle arm connecting link 100 and the throttle follower link 104, as well as the outer end of the control arm 109. Because the control arm 109 is relatively long compared to the arc 130, the arc 130 is approximately a straight line, which, in effect, causes the link 100 to move approximately axially, thus maintaining an approximate parallelism between the links 100 and 95. This approximate parallelism is desirable so that rotation of the override throttle shaft 29 is transmitted essentially equally to the main throttle shaft 31, although exact parallelism is clearly not attained due to the slight curvature of the arc 130, and limited swinging of the links 95 and 100. Thus locus of the adjacent hinged ends of the override throttle arm connecting link 100 and the throttle follower means 104 approaches a straight line. However, for the purpose of this apparatus, hinging the control arm 109 to the casing and to the throttle follower means 104 serves as a parallelogram means to maintain the connecting links generally parallel to each other during rotation of the overridge throttle shaft so as to ensure generally equal rotations of the override and the main throttle shafts 29 and 31 respectively. Other means to ensure generally equal rotation of the shafts 29 and 31 can be substituted.

It can be seen that the roller 112 is restrained laterally by the guide means 57 to be positioned directly beneath the clutch shaft 32, and thus the roller 112 serves as an essentially fixed pivot for rocking of the throttle follower link 104. Referring to FIG. 2 only, the roller 112 must remain essentially stationary with respect to the V-shaped guide means 57 of the cam 56, otherwise, if the cam were moved during rotation of the throttle shaft, accidental engagement of a gear may occur due to corresponding rotation of the clutch shaft 32.

Figure 6:
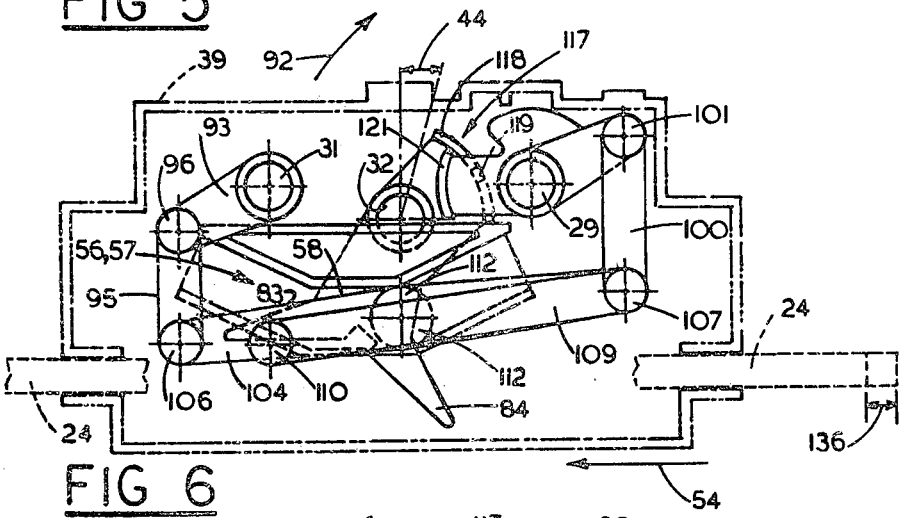
FIG. 6 is a further simplified diagram similar to FIG. 2 with the forward gear engaged and the throttle at idle.

Referring mainly to FIG. 6, as in FIG. 2 the shafts 29 and 31 are shown again at idle, but the cam 56 has now been shifted axially per the arrow 54 by movement of the input bar 24 a distance 136. The distance 136 equals the spacing 73 and thus the springloaded detent 66 has now engaged, see FIG. 2, the recess 71 representing forward gear engagement following intermediate cam travel. Because the inner portion 58 of the V-shaped guide means is parallel to axial movement of the bar 24, again there is no lateral movement of the roller 112 relative to the groove and thus there is no corresponding motion of the throttle follower link 104, or throttle shafts 29 or 31. The roller 112 is thus positioned essentially vertically beneath the recess 71 at the same vertical spacing as shown in FIG. 2. Thus the clutch operating shaft 32 is rotated through the angle 44 to attain the forward gear engaged position with no change in engine idle speed setting. It can be seen that rotation of the override throttle shaft 29 is prevented by the interlock means 117 through interference between the locator 121 and the stop portion 118.

Figure 7:
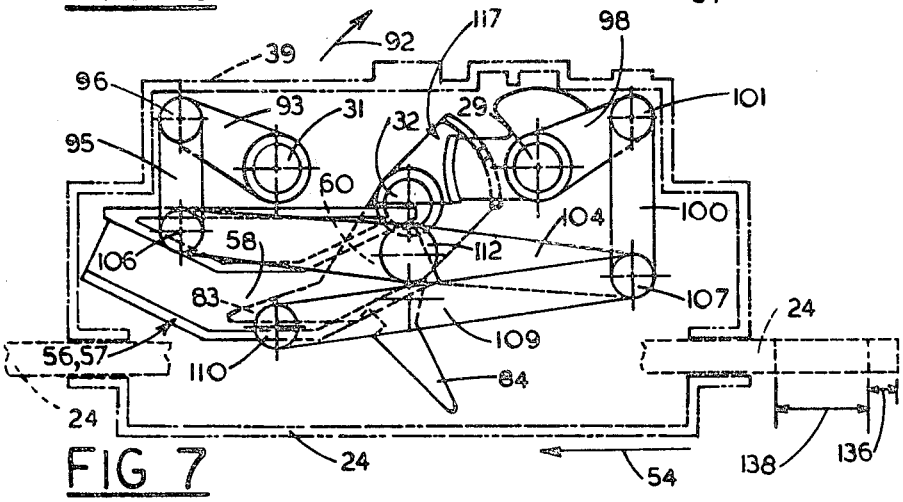
FIG. 7 is a further simplified diagram similar to FIG. 6 with the forward gear engaged and the throttle set at full throttle.

Referring to FIG. 7, further axial movement of the bar 24 by a distance 138 per the arrow 54 represents outer cam travel and forces the roller 112 to run upwards along the outer portion 60 of the guide means 57. It is noted that the arm 98 is again prevented from rotation by the interlock means 117 and thus the override throttle connecting link 100 and the control arm 109 locate the pin 107 at one end of the follower link 104. The upward movement of the roller 112 towards the clutch shaft 32 causes a corresponding rotation of the throttle follower link 104 in direction of the arrow 92 about the fixed pin 107. The follower link 104 provides a simple lever effect in which there is a magnification at the hinge pin 106 of the upwards movement of the roller 112. The hinge pin 106 forces the link 95 upwards, causing rotation of the throttle shaft 31 to the full speed position. Thus movement of the input shaft 24 beyond the forward gear engaged position, as defined by engaging the recess 71 of the cam, results in increase of engine speed to full throttle without effecting angular location of the clutch operating shaft 32. Thus, it can be seen that the roller 112 is a cam follower cooperating with the cam 56 and the main throttle shaft 31 so that axial movement of the cam during intermediate cam travel produces no throttle shaft movement, and axial movement of the cam during subsequent outer cam travel produces corresponding rotation of the main throttle shaft. It is seen that the override throttle shaft 29 remains at idle and is thus unaffected by this movement of the throttle shaft 31 to full throttle.

Conversely, by referring to FIG. 2 again, it can be seen that corresponding axial movement of the input bar 24 in an opposite direction produces engagement of the reverse gear followed by increase in engine speed from idle to full throttle. That is, following intermediate cam travel the recess 72 is engaged initially by the detent 66 with corresponding swinging of the clutch shaft 32 to the outer limit 47 reflecting reverse gear engaged, with no throttle shaft movement. This is followed by outer cam travel which causes similar upwards movement of the follower link 104 due to the roller 112 running on the portion 61 of the groove of the guide means 57. This upwards movement of the roller 112 swings the arm 93 as before, thus producing a corresponding full throttle signal for the main throttle shaft 31, which can be seen to have rotated in the same direction as in the full throttle condition as previously described, also without affecting the overridge throttle shaft 29.

I claim:

1. A control function splitter apparatus for controlling through at least one single lever control unit, a clutch and gearbox assembly, and a throttle associated with an engine; the control unit having a casing, a main throttle shaft adapted to cooperate with a speed control of the engine, an override throttle shaft, and a clutch operating shaft adapted to cooperate with a clutch of a reversible gearbox having an intermediate neutral position; the three shafts being journalled for rotation in the casing; the main throttle shaft and override throttle shafts being rotatable between idle and full speed positions; and the clutch operating shaft being rotatable between engaged forward and reverse positions with an intermediate position being neutral, the control function splitter apparatus being further characterized by:

(a) a cam mounted for rectilinear axial movement relative to the casing and being adapted to cooperate with the single lever control unit to reflect actuation thereof, the cam having an inner portion corresponding to intermediate cam travel and two outer portions corresponding to outer cam travel, the outer portions being positioned on each side of the inner portion, (b) a cam follower cooperating with the cam and the main throttle shaft so that axial movement of the cam during intermediate cam travel produces no throttle shaft movement, and axial movement of the cam during subsequent outer cam travel produces corresponding rotation of the main throttle shaft, (c) a motion converting means cooperating with the cam and the clutch operating shaft to convert axial movement of the cam during intermediate cam travel to rotation of the clutch operation shaft, and to prevent essentially further rotation of the clutch operating shaft during the subsequent outer cam travel, (d) interlock means cooperating with the clutch operating shaft and the override throttle shaft so that rotation of the clutch operating shaft is essentially prevented unless both throttle shafts are in their respective idle positions, and rotation of the override throttle shaft is prevented unless the clutch shaft is in neutral.

2. A control function splitter apparatus as claimed in claim 1 further characterized by:

(a) a throttle follower means cooperating with the main throttle shaft and with the override throttle shaft so that when the clutch shaft is in the neutral position, rotation of the override shaft is transmitted to the main throttle shaft.

3. A control function splitter apparatus as claimed in claim 2 further characterized by:

(a) the cam follower cooperating with the throttle follower means, so that actuation of the throttle override shaft when the clutch is in neutral is transmitted essentially directly to the main throttle shaft.

4. A control function splitter apparatus as claimed in claim 1 in which the interlock means is further characterized by:

(a) the clutch operating shaft having a rotary cam with a stop portion provided with a clearance opening, (b) the throttle override shaft has a locator which is adapted to pass through the clearance opening of the stop portion upon rotation of the throttle override shaft when the clutch operating shaft is in the neutral position; and to interfere with the stop means when the clutch operating shaft is out of the neutral position, thus preventing rotation of the throttle override shaft.

5. A control function splitter apparatus as claimed in claim 1 in which the motion converting means is further characterized by:

(a) a recess portion mounted on the clutch operating shaft, the recess portion having a recess defined in part by two inclined swept faces and an indentation provided between the swept faces, the faces being inclined at angles proportional to rotation of the clutch operating shaft between the engaged positions, (b) a driver member cooperating with the cam and interposed between the two opposed swept faces to be accepted within the indentation in the neutral position, so that axial movement of the driver in a particular direction from the neutral position through the intermediate position causes the driver member to engage a side of the indentation and one of the swept faces to initially rotate the clutch operating shaft to one of the engaged positions, and during subsequent axial movement of the cam in the same direction through outer cam travel causes the driver member to move along the swept face without further movement of the clutch operating shaft.

6. A control function splitter apparatus as claimed in claim 1 further characterized by:

(a) the cam having a generally flat-bottomed V-shaped guide means in which the inner portion of the cam is aligned with axial movement of the cam, and the outer portions of the cam represent forward and reverse throttle actuating portions extending on opposite sides of the inner portion and being inclined to movement of the cam.

7. A control function splitter apparatus as claimed in claim 6 further characterized by:

(a) a throttle follower means cooperating with the main throttle shaft and with the override throttle shaft so that when the clutch shaft is in the neutral position, rotation of the override shaft is transmitted to the main throttle shaft, (b) the flat bottomed V-shaped guide means of the cam being a groove defined by spaced side walls, (c) the cam follower being a roller journalled for rotation relative to the throttle follower means, the roller having a cylindrical periphery engaging the side walls of the groove for relative movement therebetween.

8. A control function splitter apparatus as claimed in claim 1 further characterized by:

(a) the casing having casing indexing means thereon, (b) the cam having cam indexing means complementary to the casing indexing means to assist in location the cam at either a mid position of the intermediate cam travel, or at beginning positions of outer cam travel to represent neutral, forward or reverse positions.

9. A control function splitter apparatus as claimed in claim 4 in which the interlock means is further characterized by:

(a) the stop portion and the locator being curved projecting walls having surfaces of revolution centered on the clutch operating shaft and the override throttle shaft respectively.

10. A control function splitter apparatus as claimed in claim 1 further characterized by:

(a) a throttle follower means, (b) the main throttle shaft having a main throttle arm extending rigidly therefrom, (c) a main throttle arm connecting link having one end hinged to the main throttle arm and an opposite end hinged to a first portion of the throttle follower means, (d) the override throttle shaft having an override throttle arm extending rigidly therefrom and disposed so as to be generally parallel to the main throttle arm when both the throttle shafts are in idle, (e) an override throttle arm connecting link disposed so as to be generally parallel to the main throttle arm connecting link and having one end hinged to the override throttle arm and an opposite end hinged to a second portion of the throttle follower means, (f) parallelogram means to maintain the connecting links generally parallel to each other during rotation of the override throttle shaft to ensure generally equal rotation of the throttle shafts.

11. A control function splitter apparatus as claimed in claim 10 further characterized by:

(a) the parallelogram means being a control arm hinged to the casing and to the throttle follower means, so as to restrain motion of the throttle follower means to ensure that the connecting links remain generally parallel to each other.

12. A control function splitter apparatus as claimed in claim 11 further characterized by:

(a) the control arm being relatively long and having one end hinged to an end of the throttle follower means that is also hinged to the override throttle arm connecting link, and an opposite end is hinged to the casing at a position aligned with an approximate mid portion of total stroke of the adjacent hinged ends of the override throttle arm connecting link and the throttle follower means, so that locus of the said adjacent hinged ends of the links approaches a straight line, thus maintaining approximate parallelism of the linkage.

* * * * *